United States Patent [19]

Neal et al.

[11] Patent Number: 4,770,726

[45] Date of Patent: Sep. 13, 1988

[54] TITANIUM ALLOY

[75] Inventors: Donald F. Neal, Tamworth; Paul A. Blenkinsop, Sutton Coldfield, both of England

[73] Assignee: Imi Titanium Limited, Birmingham, England

[21] Appl. No.: 814,159

[22] Filed: Dec. 23, 1985

Related U.S. Application Data

[63] Continuation of Ser. No. 720,485, Apr. 9, 1985, abandoned, which is a continuation of Ser. No. 540,855, Oct. 11, 1983, abandoned.

[30] Foreign Application Priority Data

Oct. 15, 1982 [GB] United Kingdom ..... 8229579

[51] Int. Cl.[4] ..... C22C 14/00

[52] U.S. Cl. ..... 148/407; 420/419

[58] Field of Search ..... 148/11.5 F, 12.7 B, 148/407, 421; 420/419

[56] References Cited

U.S. PATENT DOCUMENTS 4,087,282 5/1978 Neal et al. ..... 148/407

FOREIGN PATENT DOCUMENTS 2489847 3/1982 France ..... 148/133
757383 9/1956 United Kingdom .
762590 11/1956 United Kingdom .
785293 10/1957 United Kingdom .
838519 6/1960 United Kingdom .
883027 11/1961 United Kingdom .
888865 2/1962 United Kingdom .
1049624 11/1966 United Kingdom .
1079416 8/1967 United Kingdom ..... 420/419
1124114 8/1968 United Kingdom .
1124324 8/1968 United Kingdom .
1156397 6/1969 United Kingdom .
1492262 11/1977 United Kingdom ..... 420/419

OTHER PUBLICATIONS

Ayvazian et al., "Influence of Carbon and Oxygen on Some Exploratory Ultra-High Strength Alpha-Beta Titanium Alloys", *The Science, Technology and Application of Titanium,* Pergamon Press, N.Y., 1970, pp. 897-899.

Quesne et al., "A Comparative Study of Creep Resistance and Thermal Stability of Alloys 685 and 6242 in Air and Vacuum", *Titanium and Titanium Alloys,* vol. 3, Plenum Press, N.Y., 1976, pp. 2015-2026.

*Primary Examiner*—L. Dewayne Rutledge
*Assistant Examiner*—Robert L. McDowell
*Attorney, Agent, or Firm*—Cushman, Darby & Cushman

[57] ABSTRACT

A weldable titanium alloy particularly intended for use at high temperatures and under conditions of high stress in aircraft engines, the alloy having the composition 5.6% aluminium, 4% tin, 4% zirconium, 1% niobium, 0.25% molybdenum, 0.5% silicon, 0.05% carbon, optionally containing 0.2% tungsten and being used in the heat treated condition. The heat treatment would normally comprise a solution treatment above the beta transus, typically at 1080° C., and an ageing or stress relieving treatment at a temperature of approximately 650° C. for approximately 24 hours.

14 Claims, 2 Drawing Sheets

100
80
60
%
β 40
20
2
1
940
960
980
1000
1020
1040
1060
1080
1100
Tc°

500
480
460
440
420
400
380
N. mm-2
3
4
20
40
60
80
100
120
140
T. hrs.

TITANIUM ALLOY

This is a continuation of application Ser. No. 720,485 filed Apr. 9, 1985, now abandoned, which was a continuation of application Ser. No. 540,855 filed Oct. 11, 1983, now abandoned.

BACKGROUND OF THE INVENTION

This invention relates to titanium alloys and has particular reference to titanium alloys intended for use in conditions of high temperature and stress, particularly in aircraft engines.

Alloys have been proposed for use where service temperatures of up to 540° C. are encountered. It will be appreciated that the alloys do not run at such service temperatures throughout the entire time the engine is operating. The maximum temperatures developed in an engine are normally believed to exist when the engine is operating from high airfields in high temperatures during the summer under conditions of maximum load. When the engine is operating in a cruise condition at high altitudes the engine will operate at much lower temperatures. However, the engine has to be designed with the so-called hot and high conditions taken into account. It is essential, therefore, that the alloys used in the engines are capable of withstanding high temperatures even if it is not necessary that they can withstand such high temperatures for thousands or tens of thousands of hours.

In British Patent Specification No. 1 208 319 there is described the alloy containing 6% aluminium, 5% zirconium, 0.5% molybdenum, 0.25% silicon, balance titanium. The alloy is suitable for use where service temperatures of up to 520° C. are encountered. Further developments in alloy technology are described in British Patent Specification No. 1 492 262 which describes the alloy titanium, 5.5% aluminium, 3.5% tin, 3% zirconium, 1% niobium, 0.25% molybdenum, 0.3% silicon. Such an alloy is capable of operating satisfactorily at service temperatures of up to approximately 540° C.

The alloy described in this latter patent is the most advanced near alpha alloy which is capable of being used in the welded condition. By the term "weldable" as used in the present context is meant that articles manufactured from the alloy can be used in the welded condition. It is not sufficient merely to be able to stick two pieces of metal together. The alloy in the post welded condition after suitable heat treatment must have properties virtually indistinguishable from the alloy in the pre-welded condition and the welding must not introduce a zone of weakness into the structure, which would be a cause of possible failure in the aircraft engine.

Increasing concern at fuel costs is leading to the development of aircraft engines which are increasingly fuel efficient. A basic method of increasing fuel efficiency is to increase the operating temperature of the engine and to reduce its weight. This has meant that titanium is being considered for use nearer the centre of the engine, where the operating temperatures are in any case higher, and also the overall operating temperature of the engines is being increased. These developments have led to a requirement for a titanium alloy capable of operating at service temperatures of up to 600° C. It will be appreciated that to produce titanium alloys having such high service temperatures is extremely difficult. The commercial development of titanium alloys for aircraft engines is only some thirty years' old and the titanium technology is as yet an incompletely understood science. In the past increases in service temperatures of 10° or 20° C. have been the maximum which have been obtainable. To move, therefore, from an alloy capable of operating at 540° C. to 600° C. is a major leap forward. Not only has it been a requirement for alloys of the present invention that they be capable of operating at service temperatures of up to 600° C. but also the alloys have to meet operating requirements previously not considered important. Experience with operating aircraft engines has shown that the titanium alloy has to have resistance to such problems as stress rupture and low cycle fatigue in addition to all of the normal requirements of a high tensile strength, a resistance to conventional fatigue, ductility, stability, resistance to oxidation, a high creep resistance, forgability, weldability and many other properties.

In addition to changes to alloy compositions a great deal of work is being carried out to improve the properties of titanium alloys by modifying the heat treatment of the alloy. Titanium alloys of the high creep strength type are not used in the cast or forged condition but are given a series of heat treatments to modify and improve their mechanical properties. In part the present invention arises from the unexpected discovery that the presence of a certain element, namely carbon, in the alloys alters the shape of the alpha plus beta approach curve to make it practicable to work and heat treat the alloy in the alpha plus beta field. By way of explanation it is noted that titanium normally exists in two crystallographic phases, alpha and beta. The alpha phase, which is a close packed hexagonal structure, on heating, transforms at approximately 880° C. in pure titanium metal to a body centre cubic beta phase, which is stable up to the melting point of the metal. Certain elements, known as alpha stabilisers, stabilise the alpha form of titanium such that the transformation temperature for such alloys is increased above 880° C. By contrast beta stabilising elements depress the transformation temperature to below 880° C. In alloys, as opposed to the pure metal, the transformation from alpha to beta on heating the alloy does not take place at a single temperature but the transformation takes place over a range of temperatures at which both the alpha and beta phases are stable. As the temperature increases the proportion of alpha decreases and the proportion of beta increases.

It has unexpectedly been found that small quantities of carbon leads to a significant change in the shape of the approach curve of the alpha plus beta phase proportions and furthermore the present invention provides a near alpha titanium alloy which, for the first time, can be not only fusion welded but is usable when it has been thermo-mechanically processed in either beta, alpha plus beta or beta plus silicide fields. Thus the present invention not only provides an alloy capable of being used in the alpha beta heat treated condition but also has transformation characteristics so as to make alpha beta heat treatment a practical proposition.

All compositions as used in this specification are expressed in terms of weight percentage. Thus all percentages as used herein will be weight percentage unless specifically indicated otherwise.

SUMMARY OF THE INVENTION

By the present invention there is provided a weldable titanium alloy having the composition 5.35–6.1% aluminium, 3.5–4.5% tin, 3.25–5% zirconium, 0.5–1.5% niobium, 0.15–0.75% molybdenum, 0.4±0.2% silicon, 0.03–0.1% carbon, balance titanium apart from incidental impurities.

The alloy may additionally contain tungsten in amounts between 0.1 and 0.4%, preferably 0.2%±0.05% or 0.3%.

The aluminium content is preferably 5.6%±0.25% or ±0.15% or ±0.1% or ±0.05% and further preferably is 5.6%. The tin content is preferably in the range 4–4.5% with a further preference for 4%. The zirconium content may be in the range 3.5–4.5% with a preference for 4%. The niobium content may be 1%±0.3% or ±0.2% or ±0.1% or ±0.05% with a preference for 1%. The molybdenum content may further be in the range 0.25%±0.1% or ±0.05% with a preference of 0.25%. The silicon content may be 0.2%, 0.25%, 0.35% or 0.4% or 0.45% or 0.5% or 0.55% or 0.6%, but is preferably 0.5%.

The carbon level may further preferably be in the range 0.04–0.075% or in the range 0.04–0.06% with a preferred composition of 0.05%.

The alloy may be heat treated by a solution heat treatment in the beta field or in the beta plus silicide field or in the alpha plus beta field followed by an oil quench or an air cool and an age. Typically the alloy could be solution treated at a temperature of 25° C. above the beta transus. For the carbon containing alloys of the present invention, the beta transus is at approximately 1 050° C. The ageing treatment would typically comprise 5 hours heat treatment at 650° C. followed by an air cool. After beta solution treatment the cooling may be by oil quenching or by air cooling. Typically, therefore, the alloy could be beta solution treated at 1 075° C. and air cooled or oil quenched (depending on section size—the larger the section the more likely the cooling would be by oil quenching) followed by a single ageing for 5 hours at 650° C.

Alternatively the alloy may be heat treated in the beta plus silicide region at approximately 1 025° C. Even large sections of alloy having this heat treatment may be air cooled, giving less retained internal stress and more consistent properties through the section. After this solution treatment the alloy may be aged as above and below.

In a further alternative the alloy may be heat treated at 1 000° C. which is an alpha plus beta heat treatment in which the alloy nominally contains approximately 10% alpha followed by an oil quench or air cool. The alloy may then be aged as before.

Instead of a single ageing a duplex ageing treatment may be given such as 24 hours at 500° C. to 600° C., typically 535° C., air cooled followed by a further 24 to 48 hours at 625° C. to 700° C.

It will be appreciated, therefore, that in part the present invention is based on the discovery that the rate of change of the alpha to beta in the alpha plus beta region, in which both alpha and beta phases co-exist, is slow in the upper regions of the field enabling a selection of temperatures to be used for alpha plus beta thermo-mechanical treatment, combined with the fact that the material is strong and further combined with the fact that the material may be used in the alpha plus beta heat treated condition.

The invention is also partly based on the discovery that thermo-mechanical treatment in the beta plus silicide region followed by air cooling gives a product which has a sufficiently fine structure to be useful whilst having lower retained internal stress than would be the case with oil quenched material.

It has further been found that in alloys of the invention there appears to be a synergistic effect on creep strength of the combination of silicon and zirconium contents.

Insofar as the alloy is a tungsten containing alloy the invention is further based on the discovery that tungsten has an ability to increase the strength of the material whilst simultaneously increasing the resistance to creep extension and that there is an optimum level of tungsten at approximately 0.2%.

BRIEF DESCRIPTION OF THE DRAWING

By way of example embodiments of the present invention will now be described with reference to the accompanying drawings, of which.

DESCRIPTION OF THE PREFERRED EMBODIMENTS

An initial comparison was made between a base composition comprising 5.6% aluminium, 4.5% tin, 3% zirconium, 0.7% niobium, 0.25% molybdenum, 0.4% silicon with and without the addition of 0.07% carbon. The effect of carbon is given in Table I:

TABLE I

| | 0.2% PS $N \cdot mm^{-2}$ | UTS $N \cdot mm^{-2}$ | EL5D % | RinA % |
|---|---|---|---|---|
| Base | 932 | 1060 | 10.5 | 17.5 |
| Base + 0.07% carbon | 1038 | 1146 | 4.5 | 5 |
| IMI 829 | 848 | 966 | 11.5 | 24 |
| IMI 829 + 0.05% carbon | 917 | 1028 | 10 | 18 |
| IMI 829 + 0.1% carbon | 937 | 1069 | 9 | 18 |

By comparison Table I also includes the alloy IMI 829 without carbon and with two levels of carbon additions. IMI 829 is the optimum high strength weldable creep alloy described in British Patent Specification No. 1 492 262 having the composition Ti+5.5% Al+3.5% Sn+3% Zr+0.25% Mo+1% Nb+0.3% Si and which represents the strongest and most effective prior art alloy which is both usable in the welded condition for aircraft engines and which is capable of operating under high temperatures and stress conditions. It should be noted that carbon additions to IMI 829 do not reduce the ductility of the alloy whereas they appear to on the new base. However, analysis of the new base shows a high oxygen level of 0.15% and it would appear that this would reduce the ductility somewhat. As the strength of 1 146 $N.mm^{-2}$ is well above that required for commercial applications there is a large margin for the trading of improved ductility against a reduction in strength.

Figure 1:
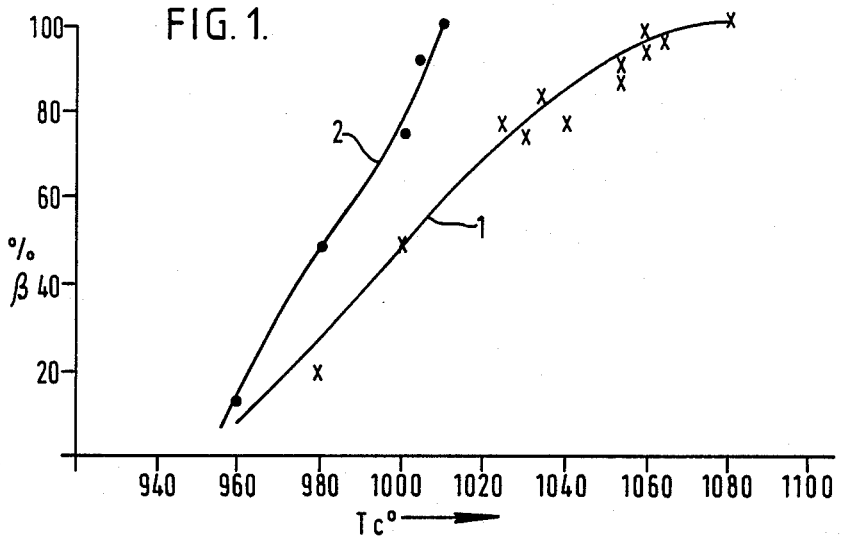
FIG. 1 is an approach curve being a graph showing percentage beta phase against temperature for the optimum prior art alloy and an alloy of the present invention.

A determination of the transus for the 0.07% carbon-containing alloy of the present invention gave a beta transus level of 1 075° C. The results of the determination of the amount of beta present in IMI 829 and the alloy of the present invention, containing 0.07% carbon to the base, is illustrated in the approach curves in FIG. 1. On heating the alloy of the present invention containing 0.07% carbon the initial crystal structure is substantially an alpha structure, but as the temperature reaches the alpha-beta transus small quantitites of beta are formed. When the temperature reaches the alpha plus beta-beta transus the alloy transforms completely to a beta structure. It has also been found that at high levels of beta there are significant quantities of a silicide present such that it may be considered that there is a beta plus silicide region in the upper portions of the alpha plus beta phase field.

Clearly the fact that the alpha to alpha plus beta transus is at one temperature, typically 950° C., and the alpha plus beta to beta transus is at a higher temperature is not sufficient to indicate the percentage of beta present at all temperatures between the two transus temperatures. A determination of the amount of beta present in the alloy IMI 829 shows that the line connecting the two transus temperatures is almost straight, see line 2 of FIG. 1. This means that there is a steady change in the amount of beta present as the temperature is altered. The line 2 is known technically as an approach curve. By comparison the approach curve for an alloy of the present invention, comprising the base plus 0.07% carbon, has a very different shape and is illustrated by line 1 in FIG. 1. There are two important differences between line 1 and line 2. Firstly the absolute values for the alpha plus beta to beta transus are very different for the prior art alloy and an alloy of the present invention. Secondly, and of even greater importance, the shape of the approach curve for an alloy of the present invention is very different to that of the prior art alloy. It can clearly be seen that the upper portion of the approach curve 1 is significantly flatter than the upper portion of the approach curve 2.

The usable alpha plus beta range for alpha plus beta heat treatment, whether a solution treatment or a mechanical treatment, may be considered to be 50% alpha 50% beta to trace alpha majority beta. It can be seen that for the IMI 829 alloy the 50% beta content occurs at approximately 980° C. and the 100% beta content occurs at approximately 1 010° C. Thus the maximum temperature range in which IMI 829 can be alpha plus beta heat treated is 30° C. By comparison the 50% beta content for an alloy of the present invention is approximately 1 000° C. and the 100% is at 1 075° C. Thus the usable temperature range is 75° C. It can be seen, therefore, that the usable temperature range is over twice as great for the alloy of the present invention compared to the optimum prior art alloy.

In terms of commercial heat treatment processes this is very significant in that it is impossible to control furnace temperatures to an exact temperature and it is accepted that there is a normal small variation in temperatures in use. Further the alloy composition of one batch of an alloy are never exactly the same as the alloy composition of a second batch. This slight compositional variation from batch to batch may mean a slight variation in the alpha plus beta to beta transus temperature. The fact that there is a 75° C. temperature range in which alpha plus beta solution treatment can be given compared to 30° C. for the prior art is a very significant factor.

It is not only the breadth of the working range which is important but also the shape of the curve with its significantly flat region in the upper temperature range. Because of the inherent difficulties of working carbon containing alloys the ability to work at high temperatures is very useful. Working at a high temperature reduces the amount of load involved. Because the flat portion of the curve is at the upper region the operating stresses required to carry out alpha plus beta working are lower than they would have been had it happened that the flat portion was at the lower region. Furthermore if the flat portion of the curve were in the lower region it would be at low percentage beta contents, again making working difficult if not impossible.

It will also be appreciated that the conventional method of alpha plus beta working is to heat the alloy to a temperature at the top of the alpha plus beta range, to withdraw the alloy from the furnace and to work it in the open air. The alloy rapidly cools as a result of radiant cooling together with contact with the cold tools. By more than doubling the useful alpha plus beta temperature range the time available for alpha plus beta working is doubled and thus the number of re-heats necessary to carry out a given amount of work is halved.

In many cases ductility is as important a property in an alloy as the ultimate tensile strength of the alloy. Thus provided the UTS is at an acceptable level, which is set arbitrarily at 1 030 $N.mm^{-2}$, increases in strength above that level may be unnecessary. For reasons of toughness, therefore, increases in ductility may be more advantageous than mere increases in strength. In this case the ability to alpha plus beta heat treat the alloy, in part because of its high beta transus and together with the nature of the alloy, may be of considerable significance.

Table II below shows the results of varying the heat treatment, to both the base and the invention, with different heat treatment regimes.

TABLE II

| Heat Treatment | Alloy | 0.2% PS $N \cdot mm^{-2}$ | UTS $N \cdot mm^{-2}$ | EL5D % | RinA % |
|---|---|---|---|---|---|
| Beta SHT OQ | Base | 1002 | 1109 | 9 | 14.5 |
| +535° C./24 hr +625° C./24 hr | Base + 0.07% carbon | 1021 | 1123 | 9 | 12 |
| Alpha + beta SHT 1 055° C./ 1 hr OQ + 5 hr 650° C. AC | Base + 0.07% carbon | 990 | 1109 | 11 | 14 |
| Alpha + beta SHT 1 055° C./ 1 hr AC + 5 hr 650° C. AC | Base + 0.07% carbon | 962 | 1091 | 12 | 18 |

KEY
SHT = solution heat treat
OQ = oil quench
AC = air cooled
Base = titanium plus 5.6% aluminium, 4.5% tin, 3% zirconium, 0.7% niobium, 0.25% molybdenum, 0.4% silicon
PS = proof strength
UTS = ultimate tensile strength
$N \cdot mm^{-2}$ = Newtons per $mm^2$
EL5D = the elongation in tensile tests on a gauge length of 5 times the diameter of the sample
RinA = reduction in area All tests were room temperature tensile tests of material which had not been stressed in any way after initial manufacture, heat treatment and machining.

It can be seen that the alloys of the present invention are capable of being alpha beta heat treated, i.e. heat treated in the alpha plus beta field to give very acceptable tensile strengths with acceptable ductility.

The materials used in aircraft engines have also to be highly resistant to stress rupture. Stress rupture strength is the ability of a material to withstand rupture at a high temperature under a constant applied load. In a stress rupture test the alloy is stressed by a high load and the load is maintained on the sample until the sample ruptures. The time to rupture is noted. A series of stress rupture tests were carried out at different stress levels at 600° C. and the results of the tests are given in Table III.

TABLE III

| Stress Rupture (at 600° C.) | | | |
|---|---|---|---|
| IMI 829 | | Base + 0.07% carbon | |
| Stress ($N \cdot mm^{-2}$) | Rupture Life (hrs) | Stress ($N \cdot mm^{-2}$) | Rupture Life (Hrs) |
| 500 | 22⅓ | 500 | 27¼–44.5* |
| 450 | 31½ | 450 | 64½ |
| 430 | 39½ | 430 | 85¼ |
| 400 | 72¼+ | 410 | 94½ |
| 380 | 139 | 400 | 94⅔ |

*Load relieved for some time during the period 26½–43¾hrs
+Small furnace temperature variation at end of test It can be seen, therefore, that the alloy of the present invention is approximately twice as resistant to stress rupture as the optimum alloy of the prior art, namely IMI 829. By way of explanation it is noted that the rupture life given for the invention at a stress of 500 $MNm^{-2}$ is not exact as the load was relieved for some time during the period of 26½ to 43.75 hours. With a stress rupture test a very high stress is applied to a sample causing rapid creep of the sample. The equipment is normally automatic in that it detects failure of the sample and removes the load after failure has occurred. With the first sample at a stress of 500 $N.mm^{-2}$ the sample crept to such an extent that the equipment automatically relieved the load. The sample had been checked after the 26½ hour period and was known to be in good condition at that stage but when checked again after 43¾ hours the load had been relieved. It was reapplied and the sample failed ¾ hour later. It is for this reason that the rupture life is given as 27¼ to 44½ hours as it is not known whether the load relieved shortly after the initial 26½ hours or shortly before the 43¾ hours.

Figure 2:
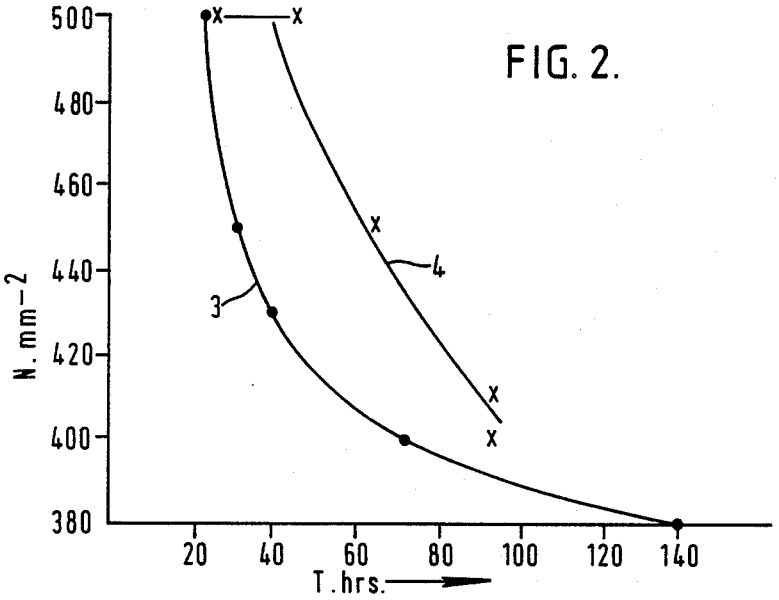
FIG. 2 is a graph of stress against time showing stress rupture results.

FIG. 2 shows clearly the improvement in stress rupture results to be obtained by the use of the present invention against the prior art optimum alloy IMI 829. The IMI 829 results, left hand curve 3, can be seen to be only approximately half that of the right hand curve 4, the invention, in terms of the number of hours to rupture at any given stress. This is particularly the case for higher stress levels.

An unusual effect of the combination of zirconium and silicon has been observed in alloys of the type described in this application at temperatures of applied creep loads at 600° C. It had previously been thought that zirconium had a small but relatively insignificant effect on creep strength at values between 3% and 4%. The effect was believed to be beneficial but not significant. It had also been believed, prior to the present invention, that the effect of silicon was to improve creep strength up to levels of approximately 0.25%, this level corresponding approximately to the limit of solubility of silicon in alloys of the present type. Silicon was, heretofor, thought to be ineffective at levels beyond approximately 0.25%.

Figure 4:
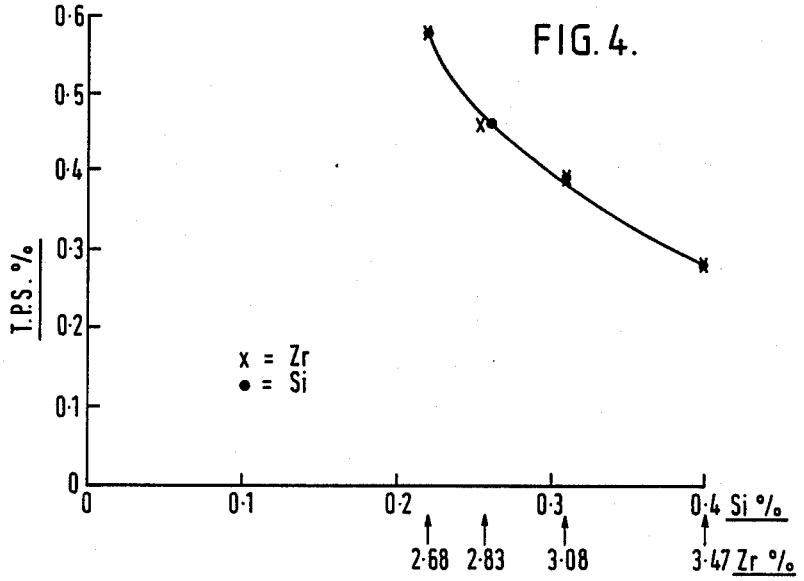
FIG. 4 is a graph of total plastic strain against silicon or zirconium contents.

It has now been discovered that silicon and zirconium together improve creep strength significantly. The information illustrated in FIG. 4 shows that the total plastic strain TPS % measured at 600° C. at an applied stress of 200 $N.mm^{-2}$ shows a reduction from 0.55% after 100 hours to 0.275% after 100 hours when the silicon content increases from 0.2% to 0.4%. It can also be seen that the zirconium content, when plotted against total plastic strain on a linear basis, also follows exactly the same curve as that of the silicon. Whether this is due to the presence of a complex silicide or for some other reason, such as the temperature at which the material is tested, is unknown.

In addition to the beneficial effects to be obtained by the presence of carbon, it has been discovered that tungsten additions further improve the alloy of the present invention and that a very small quantity of tungsten, 0.2%, optimises both the creep strength and the tensile strength in the alloy.

In order that an examination of the effects of tungsten could be made a series of ten buttons were melted utilising a base essentially consisting of 5.6% aluminium, 4.5% tin, 3% zirconium, 0.65% niobium, 0.2% molybdenum, 0.4% silicon, with oxygen levels between 900 and 1 400 parts per million. In the accompanying Table IV the chemical analyses for the various samples is given.

TABLE IV

| Chemical Analyses | | | | | | | | | |
|---|---|---|---|---|---|---|---|---|---|
| Button No | Al % | Sn % | Zr % | Nb % | Mo % | Si % | W % | $O_2$ ppm | Cu ppm |
| 1 | 5.30 | 4.47 | 2.97 | 0.63 | 0.21 | 0.38 | 0.07 | 900 | 25 |
| 2 | 5.39 | 4.49 | 2.97 | 0.63 | 0.21 | 0.38 | 0.08 | 950 | 65 |
| 3 | 5.57 | 4.39 | 3.01 | 0.65 | 0.20 | 0.39 | 0.10 | 1050 | 200 |
| 4 | 5.58 | 4.58 | 3.02 | 0.64 | 0.20 | 0.39 | 0.10 | 1100 | 30 |
| 5 | 5.57 | 4.57 | 2.95 | 0.63 | 0.19 | 0.40 | 0.37 | 900 | 15 |
| 6 | 5.63 | 4.45 | 2.91 | 0.63 | 0.20 | 0.45 | 0.45 | 1400 | 35 |
| 7 | 5.91 | 4.36 | 2.99 | 0.65 | 0.20 | 0.41 | 0.47 | 900 | 25 |
| 8 | 5.58 | 4.38 | 3.08 | 0.66 | 0.21 | 0.41 | 0.51 | 900 | 50 |
| 9 | 5.67 | 4.53 | 3.00 | 0.64 | 0.21 | 0.42 | 0.93 | 1150 | 40 |
| 10 | 5.54 | 4.38 | 2.92 | 0.62 | 0.21 | 0.41 | 0.78 | 1250 | 45 |

It will be noted that there is a reference to the copper content of the alloy. Copper was not a deliberate addition but there is a small copper pick-up as a result of the initial melting of the alloy into the water cooled copper crucible. Some comment is also necessary regarding the analysed tungsten levels in the buttons. Tungsten pick-up is known to occur in non-consumable arc melting. There is, thereforce, some variation in the tungsten levels in the buttons but this tends to be due to small lumps from the tungsten electrode adding to the total. However, as these tungsten particles tend to be discrete it is believed that the particles do not affect the property levels and, therefore, the nominal tungsten additions have been used when plotting the results.

All of the buttons were beta processed to form 13 mm diameter bars. All of the bars were then beta heat treated at 1 050° C. for ¾ hour and air cooled and were subsequently aged for 2 hours at 625° C. and air cooled. Room temperature tensile tests (RTT) were then carried out on samples of the material to measure the 0.1% proof stress (PS), the 0.2% proof stress and the ultimate tensile strength (UTS). From the broken samples the elongation was measured on a gauge length of 5 times the diameter (EL5D). Additionally the reduction in area was calculated at the break point in the sample.

On further samples of the material creep tests were carried out at a temperature of 600° C. using an applied strain of 200 Newtons per mm² (N.mm$^{-2}$). The elongation was measured after 100 hours and after 300 hours. The results are given in Table V below.

TABLE V

| Button Number | Nominal and (Analysed) (Tungsten) (Level) | Test Condition | Tensile and Creep Properties: Total Plastic Strain 600° C. 200 N · mm$^{-2}$ 100 hr % | 300 hr % | 0.1% PS N · mm$^{-2}$ | 0.2% PS N · mm$^{-2}$ | UTS N · mm$^{-2}$ | EL5D % | RinA % |
|---|---|---|---|---|---|---|---|---|---|
| 1 | 0 | RTT | — | — | 845 | 868 | 987 | 12 | 24.5 |
| | (0.07%) | Creep | 0.251 | 0.589 | — | — | — | — | — |
| 2 | 0.1% | RTT | — | — | 837 | 868 | 997 | 13.5 | 25 |
| | (0.08%) | Creep | 0.216 | 0.459 | — | — | — | — | — |
| 3 | 0 | RTT | — | — | 848 | 875 | 992 | 11 | 23 |
| | (0.10%) | Creep | * | | | | | | |
| 4 | 0.1% | RTT | — | — | 861 | 901 | 1024 | 14 | 20 |
| | (0.1%) | Creep | 0.146 | 0.295 | — | — | — | — | — |
| 5 | 0.2% | RTT | — | — | 868 | 908 | 1028 | 12 | 24.5 |
| | (0.37%) | Creep | 0.153 | 0.325 | — | — | — | — | — |
| 6 | 0.4% | RTT | — | — | 884 | 924 | 1075 | 10 | 17 |
| | (0.45%) | Creep | 0.222 | 0.408 | — | — | — | — | — |
| 7 | 0.2% | RTT | — | — | 863 | 895 | 1028 | 11 | 19 |
| | (0.47%) | Creep | 0.125 | 0.228 | — | — | — | — | — |
| 8 | 0.4% | RTT | — | — | 850 | 882 | 1021 | 12 | 22 |
| | (0.51%) | Creep | 0.191 | 0.384 | — | — | — | — | — |
| 9 | 0.8% | RTT | — | — | 874 | 907 | 1057 | 10 | 15 |
| | (0.78%) | Creep | 0.204 | 0.372 | — | — | — | — | — |
| 10 | 0.8% | RTT | — | — | 864 | 892 | 1052 | 11.5 | 21 |
| | (0.93%) | Creep | 0.183 | 0.326 | — | — | — | — | — |

*Sample not tested because material contaminated

Figure 3:
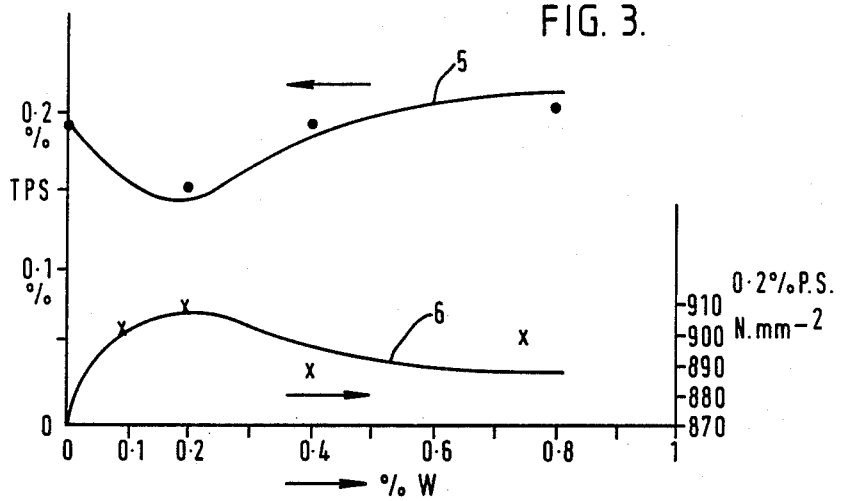
FIG. 3 is a graph showing total plastic strain (TPS) in 100 hours at 600° C. at 200 $N.mm^{-2}$ stress and the 0.2% proof strength (PS) for varying tungsten levels.

Referring to the FIG. 3 this shows that the creep strength, upper line 5, has an optimum value at tungsten levels of 0.2%. (The level of creep strength at 0% tungsten is given as 0.19% rather than the 0.25% given in Button 1, Table V. This is because it was felt that Button 1 was an unrepresentative result because of the unusually low level of aluminium compared to the other aluminium contents.) Similarly the 0.2% proof strength 6 is also greatest at 0.2% tungsten levels. It is not known why these two improvements should both optimise at the same level of tungsten addition. Clearly, however, this is extremely fortuitous and furthermore the fact that the optimum occurs at such a low level of tungsten content means that the amount of the very dense tungsten metal which needs to be added to the alloy base to obtain the optimum properties is low. This means that there is a minimum increase in the density of the alloy. This is particularly important in relation to rotating parts in aircraft engines where a minimum density is required, both to reduce the inertial loading on the rotating components in the engine and to reduce the absolute weight of the engine. The information in Table V confirms that alloys 5 and 7 have a good resistance to creep and have a high strength whilst still retaining a good ductility.

A presently preferred optimum composition for the alloy of the present invention is 5.6% aluminium, 4% tin, 4% zirconium, 1% niobium, 0.25% molybdenum, 0.2% tungsten, 0.5% silicon, 0.05% carbon. The aluminium content has been set so that in combination with tin the beneficial strength effects are obtained with a minimum of instability effects which can occur from otherwise increasing the sum total of aluminium and tin contents. The silicon and zirconium contents have jointly been chosen to increase the creep strength at temperatures of 600° C. for the reasons given above. In general the ductility of alloys decreases as the creep strength increases, but with the high silicon content it is possible to heat treat and work the alloy in the beta plus silicide region between the alpha plus beta and the beta regions. This type of beta plus silicide heat treatment should improve fracture toughness of the alloy and improve crack propagation resistance. The niobium levels have been chosen to maximise stability in the alloy and the molybdenum and tungsten levels have been optimised for the reasons set out above. The carbon content has been considered at an optimum, at this stage, of approximately 0.05% as higher levels perhaps unnecessarily increase strength over and above that needed for the alloy of the present invention.

We claim:

1. A weldable titanium alloy capable of operating at service temperatures in excess of 540° C., said alloy having the composition 5.35–6.1% aluminium, 3.5–4.5% tin, 3.00–4.50% zirconium, 0.5–1.0% niobium, 0.20–0.70% molybdenum, 0.2–0.6% silicon, 0.03–0.10% carbon, the balance being titanium apart from incidental impurities, the alloy having been thermomechanically processed in the alpha plus beta field.

2. An alloy as in claim 1, in which the aluminium content is in the range 5.6%±0.25% and in which the molybdenum content is in the range 0.20–0.35%.

3. An alloy as in claim 1 in which the alloy additionally contains tungsten in amounts selected from the group consisting of 0.1 0.4%, 0.2%±0.05% and 0.3%.

4. An alloy as in claim 1 or 3 in which the aluminium content is selected from the group consisting of 5.6%±0.15%, 5.6%±0.1%, 5.6%±0.05% and 5.6%.

5. An alloy as in claim 1 or 3 in which the tin content is selected from the group consisting of 4.25%±0.25% and 4%.

6. An alloy as in claim 1 or 3 in which the zirconium content is selected from the group consisting of 3.25%, 3.50%, 3.75%, 4.0%, 4.25% and 4.5%.

7. An alloy as in claim 1 or 3 in which the niobium content is selected from the group consisting of 1%±0.3%, 1%±0.2%, 1%±0.1%, 1%±0.05% and 1%.

8. An alloy as in claim 1 or 3 in which the molybdenum content is selected from the group consisting of 0.25%±0.05% and 0.25%.

9. An alloy as claimed in claim 1 or 3 in which the silicon content is selected from the group consisting of 0.2%, 0.25%, 0.35%, 0.4%, 0.45%, 0.5%, 0.55% and 0.6%.

10. An alloy as claimed in claim 1 or 3 in which the carbon level is selected from the group consisting of 0.04–0.075%, 0.04–0.06% and 0.05%.

11. An alloy as claimed in claim 1 or 3 in which the alloy has been heat treated by a solution heat treatment in the beta field or in the beta plus silicide field or in the alpha plus beta field followed by an oil quench or an air cool and an age.

12. An alloy as claimed in claim 11 in which the age is a duplex ageing treatment in which the first portion takes place at a lower temperature than the second portion.

13. A weldable titanium alloy having the composition 5.35–6.1% aluminium, 3.5–4.5% tin, 3.00–4.50% zirconium, 0.5–1.0% niobium, 0.20–0.70% molybdenum, 0.3–0.5% silicon, the balance being titanium apart from incidental impurities, said alloy containing sufficient carbon within the range 0.03–0.10% to reduce the rate of increase in the percentage beta phase material present in the alloy as the temperature is increased between 980° C. and 1 075° C. sufficiently to enable thermo-mechanical treatment of the alloy in the range from 50% beta to trace alpha majority beta to take place over a temperature range in excess of 30° C.

14. An alloy as claimed in claim 13 wherein said rate of increase in the percentage beta phase material is sufficient to enable thermo-mechanical treatement of the alloy in the range from 50% beta to trace alpha majority beta to take place over a temperature range in excess of 50° C.

* * * * *